US005828278A

United States Patent [19]

Murata

[11] Patent Number: 5,828,278

[45] Date of Patent: Oct. 27, 1998

[54] DEFLECTION SYSTEM

[75] Inventor: Akio Murata, Kanagawa, Japan

[73] Assignee: Sony Corporation, Tokyo, Japan

[21] Appl. No.: 704,102

[22] Filed: Aug. 28, 1996

[51] Int. Cl.[6] ..... H01F 5/00

[52] U.S. Cl. ..... 335/213; 313/440; 348/828; 348/829; 335/210

[58] Field of Search ..... 335/210–214; 348/828–831; 313/440

[56] References Cited

U.S. PATENT DOCUMENTS

| | | | |
|---|---|---|---|
| 3,601,731 | 8/1971 | Christiana | 335/210 |
| 4,181,908 | 1/1980 | Yoshikawa | 335/210 |
| 4,243,965 | 1/1981 | Yoshikawa | 335/213 |
| 4,277,767 | 7/1981 | Ura | 335/210 |
| 4,378,544 | 3/1983 | Yabase et al. | 335/210 |
| 4,484,166 | 11/1984 | Osinga et al. | 335/213 |
| 4,755,714 | 7/1988 | Sluyterman | 313/440 |
| 4,841,267 | 6/1989 | Watabe et al. | 335/210 |
| 5,027,097 | 6/1991 | Ehrhardt | 335/213 |
| 5,412,362 | 5/1995 | Ikeuchi | 335/213 |
| 5,519,371 | 5/1996 | Ogawa et al. | 335/213 |

*Primary Examiner*—Michael L. Gellner
*Assistant Examiner*—Raymond Barrera
*Attorney, Agent, or Firm*—Jay H. Maioli

[57] ABSTRACT

A deflection system which improves picture distortion and misconvergence by eliminating the wrong winding of coil. in which a bobbin 20 for the deflection coil, whose partial cross section is of a funnel shape, is mounted on the outer peripheral surface of a cathode ray tube between a neck and a funnel for winding a deflection coil 26 thereon. When the deflection coil is wound from a bend onto the inner surface of a bobbin body, a coil layer regulating portion 40 is formed at a claw on the bend side. The coil layer regulating portion is a thick-wall portion formed on the inside of the claw on the bend side. By this thick-wall portion, a horizontal deflection coil 26 is wound on an average with respect to the bottom of respective bends 22 and 24 even when the horizontal deflection coil is wound from the bend 22, 24 onto the inner surface of the bobbin body. As a result, the coil is wound on an average with respect to a coil groove inside the bobbin, so that the wrong winding of coil is eliminated. Thereupon, the effective length of the coil and the coil distribution become symmetrical at the right and left of the bobbin 20, by which picture distortion and misconvergence can be improved.

2 Claims, 11 Drawing Sheets

PICTURE DISTORTION

MISCONVERGENCE

MISCONVERGENCE

DEFLECTION SYSTEM

BACKGROUND OF THE INVENTION

1. Field of the Invention

The present invention relates to a deflection system, which is suitably applied to a deflecting device for a cathode ray tube apparatus.

2. Description of the Related Art

In a cathode ray tube apparatus for a television receiving set, as shown in FIG. 8, a deflecting device for carrying out horizontal and vertical deflection of electron beams is installed on the predetermined outer peripheral surface between a neck 12 and a funnel 14 of the cathode ray tube (CRT). FIG. 8 is a side view of a bobbin (bobbin for deflection coil) 20 on which a horizontal deflection coil (not shown) is wound.

On the inner surface of a bobbin body 21, the horizontal deflection coil 26 is wound in a saddle form (refer to FIG. 10) so as to form a predetermined coil distribution as shown in FIG. 9. Since the horizontal deflection coil 26 is wound in a saddle form symmetrically in the right and left directions with respect to the tube axis of the CRT 10, the bobbin 20 is provided with bends 22 and 24 on the upper and lower outer peripheral surfaces of the bobbin body 21 to form a coil cross line portion.

As shown in FIG. 8, the bend 22 on the neck 12 side has a flange 22A and a plurality of claws 22B, so that the orientation of coil windings is changed from the bend inside to the bend outside by using the claws 22B. The bend 24 on the funnel 14 side also has a flange 24A and a plurality of claws 24B, the function of which is the same as that of the bend 22 on the neck 12 side.

FIGS. 11A and 11B shows an example of an upper bobbin in the case where the bobbin 20 is constructed as an upper and lower pair of two-piece type bobbins. FIG. 11A shows the bobbin inside (inside of the bobbin body 21) viewed from the funnel 14 side to the neck 12 side, while FIG. 11B shows the bobbin body 21 viewed inversely from the neck 12 side to the funnel 14 side; therefore, FIG. 11B shows the outside of the bobbin body 21.

On the inner surface of the bobbin body 21, ribs 34 for connecting particular claws 22B and 24B of the aforementioned plural claws are formed, and the horizontal deflection coil 26 is wound so as to form a predetermined coil distribution using coil grooves 32 surrounded by the ribs 34. Since the horizontal deflection coil 26 is wound in a saddle form as shown in FIG. 10, it is wound, for example, along the arrow-marked direction in FIGS. 12A and 12B.

FIG. 12A schematically shows both the case where one turn of the horizontal deflection coils 26 is wound (26A) and the case where several turns thereof are wound (26B). In the latter case, the coil is wound as shown in FIG. 12B at the bend 22 on the neck 12 side.

The bend 22 is of a semicircular shape, the bottom thickness of the bend 22 is constant, and the shapes of the claws 22B are the same at the right and left of the bobbin 20. FIG. 13A is a sectional view taken along the claws 30*a* and 31*b* shown in FIGS. 12A and 12B, while FIG. 13B is a sectional view taken along the claws 31*a* and 30*b*. These figures show that the bottom thicknesses and the shapes of claws are the same.

The horizontal deflection coil 26 is wound on the bobbin body 21 by using an automatic winding machine. Therefore, as shown in FIGS. 12A and 12B, the support points of coil winding start are different between the case where the horizontal deflection coil 26 is wound from the bend 22, 24 to the inner surface of bobbin body and the case where the horizontal deflection coil 26 is wound from the inner surface of the bobbin body to the bend 22, 24.

For example, as shown in FIGS. 12A and 12B, it is found that when the horizontal deflection coil 26 is wound from the bend 22, 24 onto the inner surface of the bobbin body, it is wound with the claws 31*a* and 31*b* being support points. On the other hand, when the horizontal deflection coil 26 is wound from the inner surface of the bobbin body onto the bends 22 and 24, it is wound with the inner surface of the bobbin body 21 being a support point as shown in FIG. 12A because the inner surface of the bobbin body has a cross-sectional shape as shown in FIGS. 13A and 13B.

As a result, since the inner surface of the bobbin body provides a support point when the horizontal deflection coil 26 is wound from the inner surface of the bobbin body onto the bend 22, 24, the horizontal deflection coil 26 (26B) is wound on the bends 22 and 24 on an average as shown in FIG. 13A. However, when the horizontal deflection coil 26 is wound from the bend 22, 24 onto the inner surface of the bobbin body, the horizontal deflection coil 26 is not wound on an average with respect to the bottoms of the bends 22 and 24, but is wound in a state in which the coils are biased toward the claws 31*a* and 31*b* as shown in FIG. 13B because it is wound with the claws 31*a* and 31*b* being support points. Therefore, the horizontal deflection coil 26 is not wound uniformly with respect to the coil groove 32 as shown in FIG. 12A, but it is wound in such a manner as to be very narrow on the claw side, so that an asymmetrical coil distribution is formed at the right and left of the bobbin.

The fact that the horizontal deflection coil 26 is wound in such a manner as to be biased toward the claw side means that the effective length of coil is asymmetrical at the right and left of the bobbin, so that such wrong winding of coil including asymmetry at the right and left with respect to the coil groove 32 produces a picture distortion shown in FIG. 14A or transversely unbalanced misconvergence shown in FIG. 14B or 14C.

Conventionally, to eliminate such a picture distortion or misconvergence, the right and left distribution of the horizontal deflection coil with respect to the bobbin 20 has been intentionally made asymmetrical or the number of ribs 34 has been changed at the right and left, but these measures are still insufficient. If the above-described wrong winding of coil can be improved, a problem of unbalanced conditions of coil effective length and coil distribution at the right and left with respect to the bobbin 20 can be solved.

OBJECT AND SUMMARY OF THE INVENTION

The present invention was made to solve the above problems, and an object thereof is to provide a bobbin for the deflection coil which can eliminate the wrong winding of the coil.

To solve the above problems, the present invention provides a deflection system for a cathode ray tube comprising:

- a bobbin mounted on the outer peripheral surface of the cathode ray tube between a neck and a funnel;
- a bend formed onto the inner surface of the bobbin;
- a claw formed on the bend;
- a deflection coil wound from the bend onto the inner surface of the bobbin; and
- a coil layer regulating portion being formed at the claw.

Also, the invention provides a deflection system for a cathode ray tube comprising:

a bobbin mounted on the outer peripheral surface of the cathode ray tube between a neck and a funnel;

a bend formed onto the inner surface of the bobbin;

a flange formed on the bend;

a deflection coil wound from the inner surface of the bobbin onto the bend; and a coil layer regulating portion being formed at the flange.

Describing the invention in more detail, the coil layer regulating portion 40 is formed on the claw side, which provides a support point when the coil is wound as shown in FIG. 3. The coil layer regulating portion 40 is formed as a thick-wall portion. When the coil winding direction is as shown in FIGS. 12A and 12B, the inside sides of the claws 31*a* and 31*b* are formed as thick-wall portions 40*a* and 40*b* (refer to FIG. 3). By this thick-wall portion, a horizontal deflection coil 26 is wound on an average with respect to the bottom of respective bends 22 and 24 even when the horizontal deflection coil is wound from the bend 22, 24 onto the inner surface of the bobbin body. As a result, the coil is wound on an average with respect to a coil groove 32 as shown in FIG. 1, so that the occurrence of wrong winding of the coil can be inhibited. Thereupon, the effective length of the coil and the coil distribution become symmetrical at the right and left of the bobbin 20, by which picture distortion and misconvergence can be improved.

Other objects, features and advantages of the present invention will become apparent in the following specification and accompanying drawings.

BRIEF DESCRIPTION OF THE DRAWINGS

FIGS. 14A–14C are views showing a picture distortion and so on.

DESCRIPTION OF THE PREFERRED EMBODIMENT

Embodiments according to the present invention will be hereinafter described in detail with reference to the drawings, wherein a bobbin for a deflection coil of the present invention is applied to a cathode ray tube apparatus mentioned above.

Figure 1:
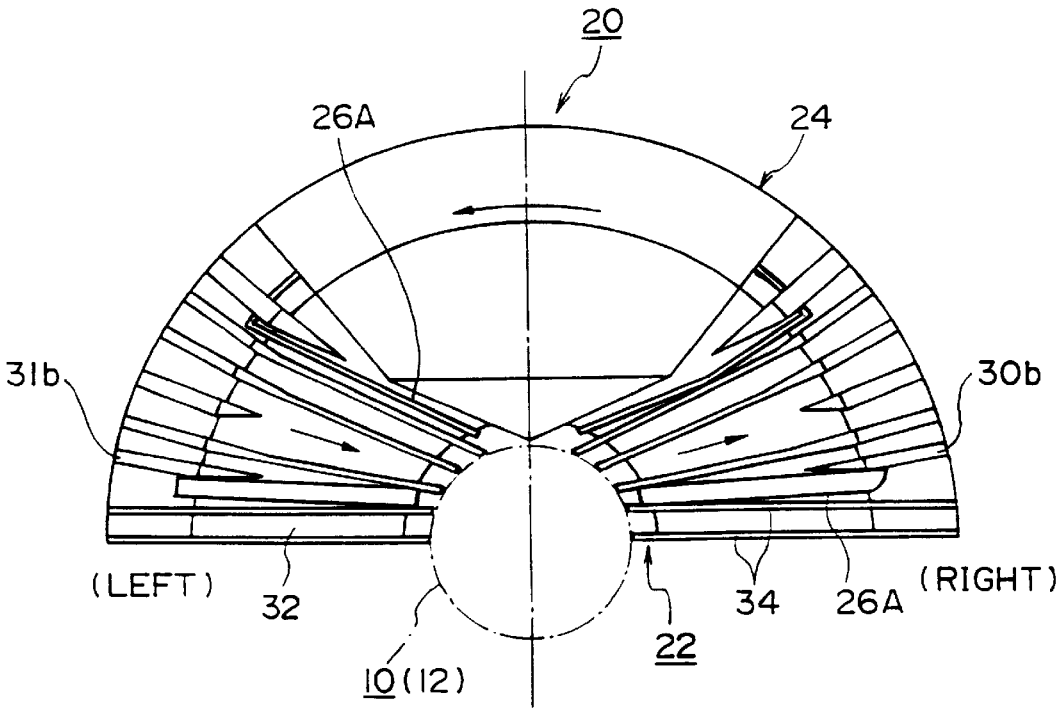
FIG. 1 is a view of a bobbin for deflection coil in accordance with the present invention, viewed from the funnel side toward the neck side.
Figure 2:
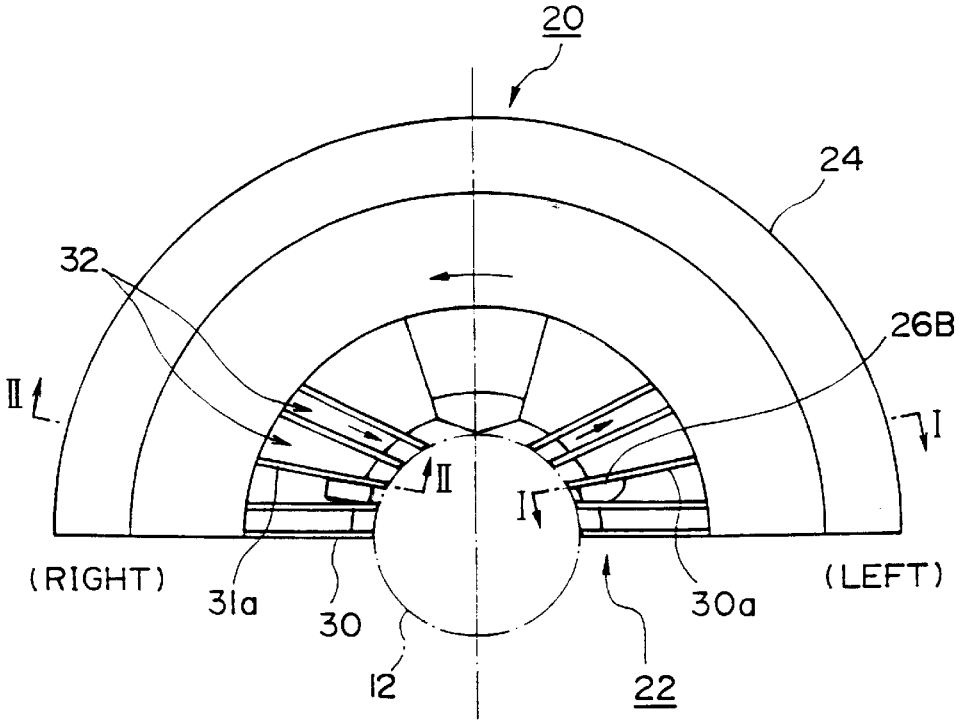
FIG. 2 is a view of a bobbin for deflection coil in accordance with the present invention, viewed from the neck side toward the funnel side.

FIGS. 1 and 2 show a horizontal deflecting device in which a horizontal deflection coil 26 is wound in a saddle form on a bobbin 20 for the deflection coil in accordance with the present invention. In these figures, one turn (26A) and several turns (26B) are shown separately at one place each for convenience of explanation. In the present invention, a coil layer regulating portion 40, which is used when the horizontal deflection coil 26 is wound from bend 22, 24 onto a bobbin body 21, is formed at a claw.

Figure 3A:
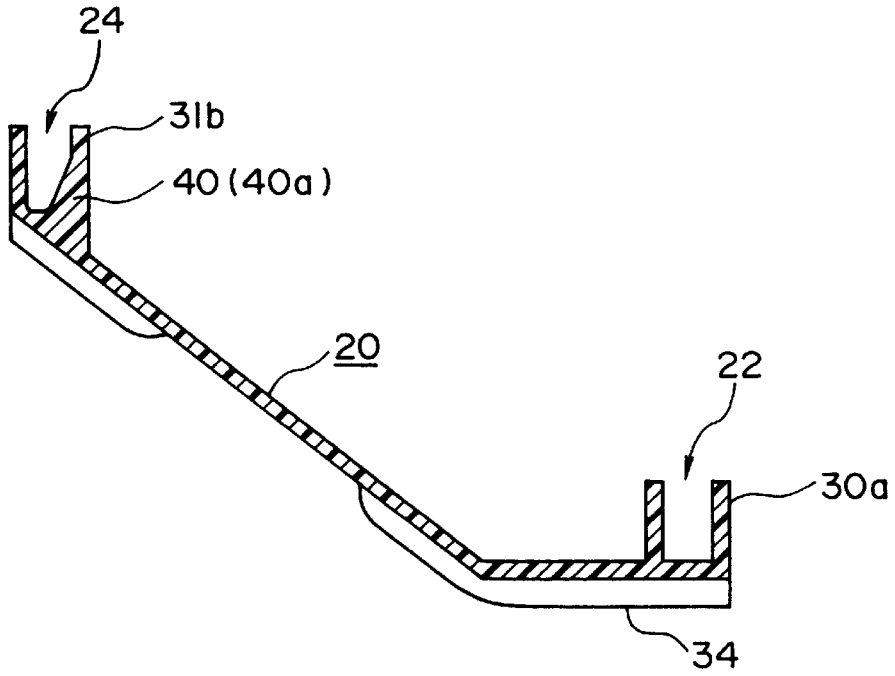
FIGS. 3A and 3B are a sectional view of FIG. 2.

Assuming that the horizontal deflection coil 26 is wound in the arrow-marked direction in FIGS. 1 and 2, the sectional view of the right claw 30*a* shown in FIG. 2 (in FIG. 1, the left claw 31*b*) is as shown in FIG. 3A. Likewise, the sectional view of the left claw 31*a* shown in FIG. 2 (in FIG. 1, the right claw 30*b*) is as shown in FIG. 3B.

In the present invention, the coil layer regulating portion 40 (40*a*) is provided only at the claw which provides a support point when a coil is wound at the bend 24 on the funnel 14 side, and therefore at the claw 31*b* in FIG. 3A corresponding to FIG. 1. Likewise, the coil layer regulating portion 40 (40*b*) is provided at the claw which provides a support point when a coil is wound at the bend 22 on the neck 12 side, and therefore at the claw 31*a* in FIG. 3B corresponding to FIG. 2.

Figure 3B:
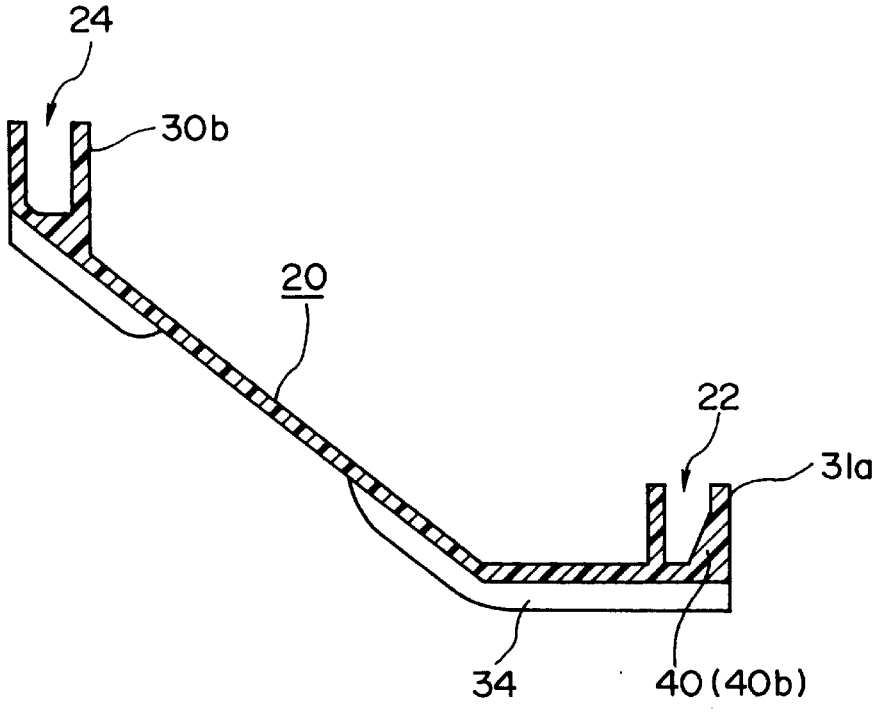
Figure 5:
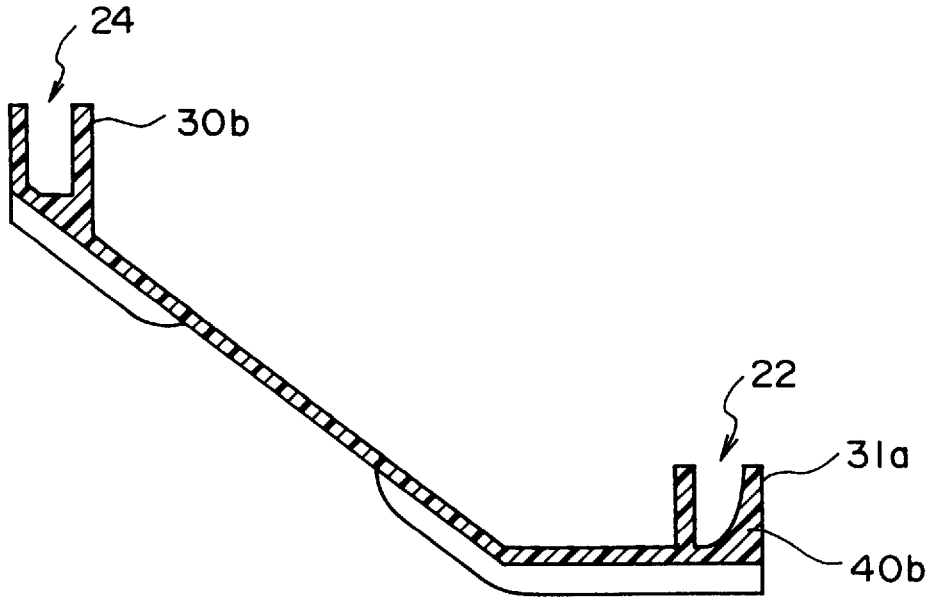
FIG. 5 is a sectional view of a modification of FIGS. 3A and 3B.

The coil layer regulating portion 40 is constructed as a thick-wall portion, and integrally formed on the inside of the claw 31*b* as shown in FIGS. 3A and 3B. Although the coil layer regulating portion 40 shown in FIGS. 3A and 3B is a thick-wall portion simply having an inclined face, it may be formed as a thick-wall portion having a curvature as shown in FIG. 5.

The coil layer regulating portion 40 is provided at all claws on the side which acts as a support point when a coil is wound. Therefore, regarding the funnel 14, the coil layer regulating portion 40 as described above is provided at all of a plurality of claws installed on the left side of the bobbin 20 shown in FIG. 1, while regarding the neck 12, it is provided at all of a plurality of claws installed on the left side of the bobbin 20 shown in FIG. 2. As a modification, such a coil layer regulating portion 40 can be provided only at several claws located on the outer peripheral side.

Figure 4A:
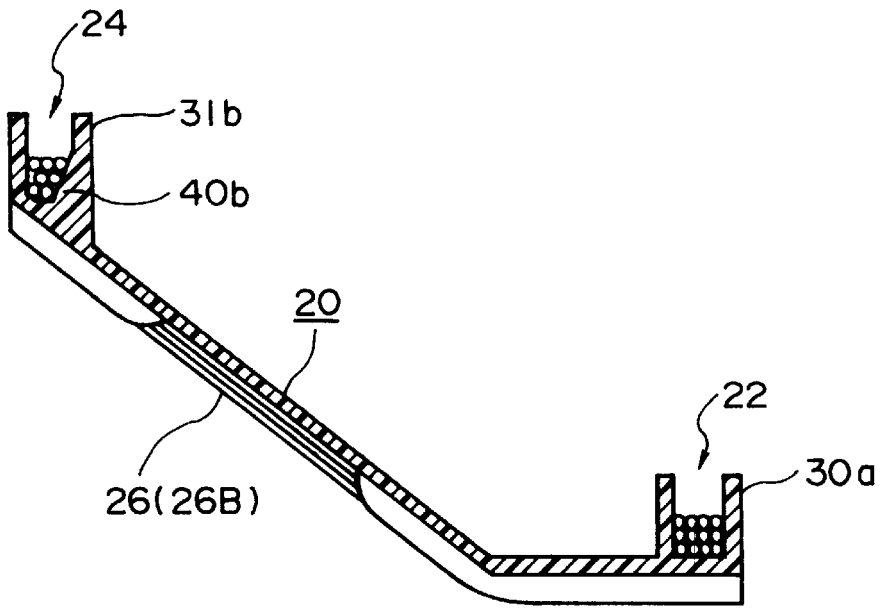
FIGS. 4A and 4B are sectional views, which are similar to FIGS. 3A and 3B of a bobbin on which a coil is wound.
Figure 4B:
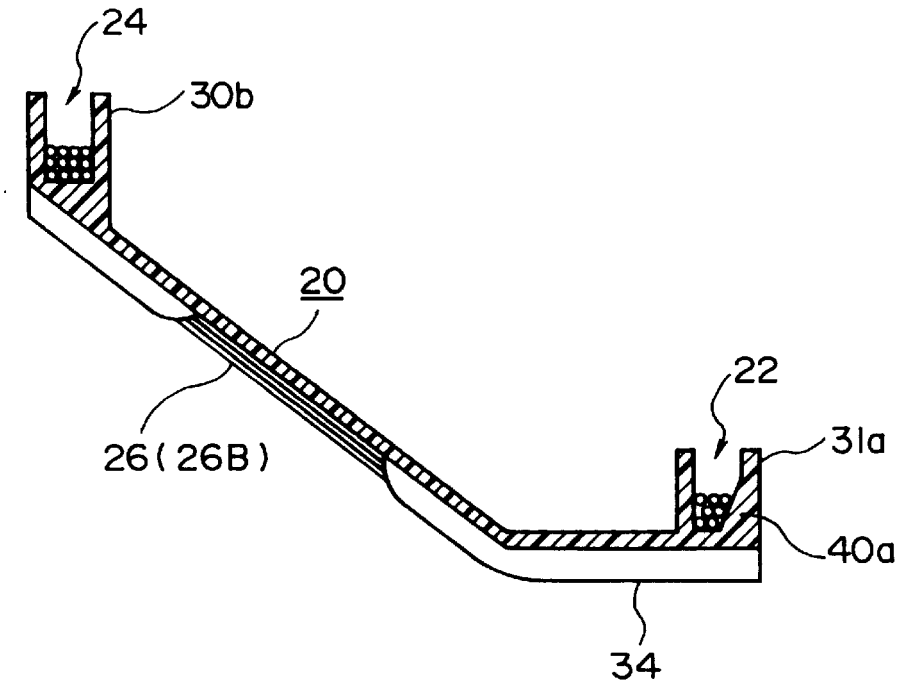

When the coil layer regulating portion 40 is provided at both of the bends 22 and 24, a coil is wound in a well-balanced manner by means of the thick-wall portion of the coil layer regulating portion 40 even when the coil is wound with the claw being a support point, so that the coil is wound on an average at the bottoms of the bends 22 and 24 as shown in FIGS. 4A and 4B. Therefore, the effective lengths of coil at the right and left of bobbin are not so different as to be not permissible.

In winding a coil, the coil is not biased to one side toward the claw side due to the winding direction of the coil, so that even when the coil is wound on the bobbin body 21, the coil can be wound in a well-balanced manner with respect to a coil groove 32 on the left side of bobbin as shown in FIG. 1, by which the symmetry of coil distribution on the inner surface of bobbin at the right and left is improved.

Figure 14A:
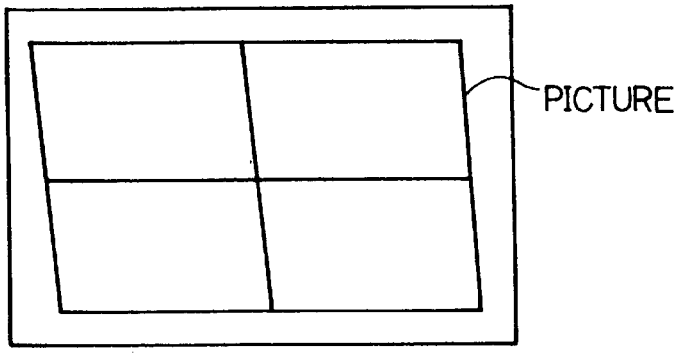
Figure 14B:
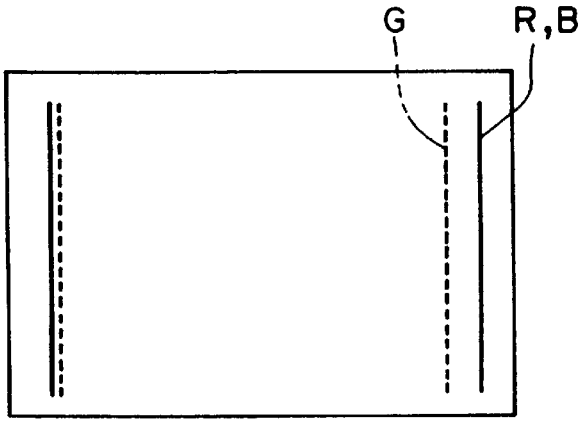
Figure 14C:
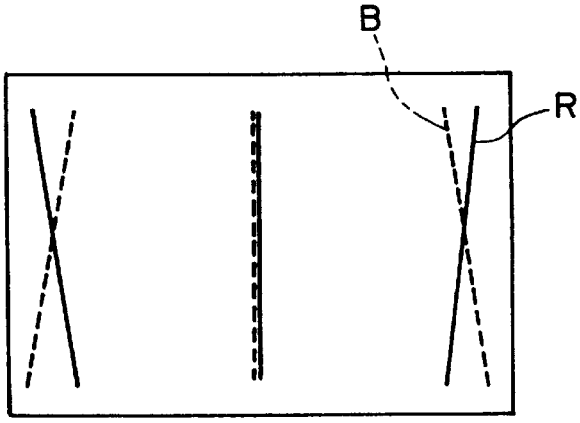

Thus, the variations in effective length of the coil at the right and left of the bobbin and the unbalance of coil distribution at the right and left with respect to the coil groove are eliminated. Only the elimination of the the wrong winding of the coil can prevent the occurrence of picture distortion as shown in FIG. 14A and improve the misconvergence as shown in FIGS. 14B and 14C.

Figure 7:
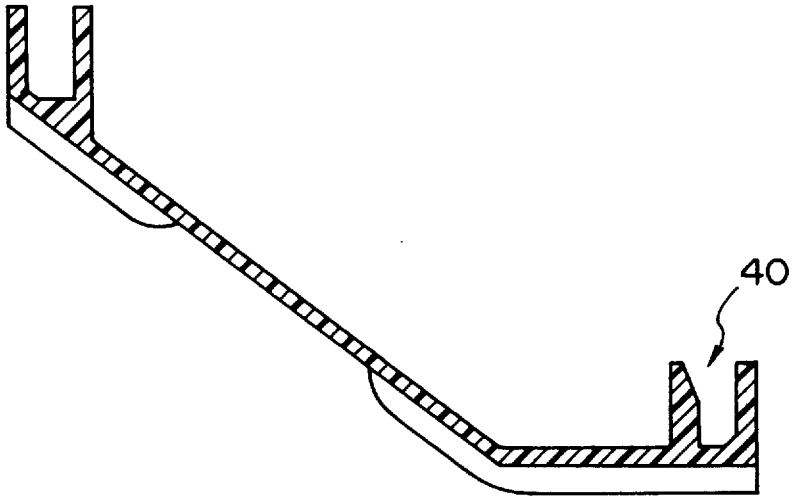
FIG. 7 is a sectional view of a modification of FIGS. 6A and 6B.
Figure 6A:
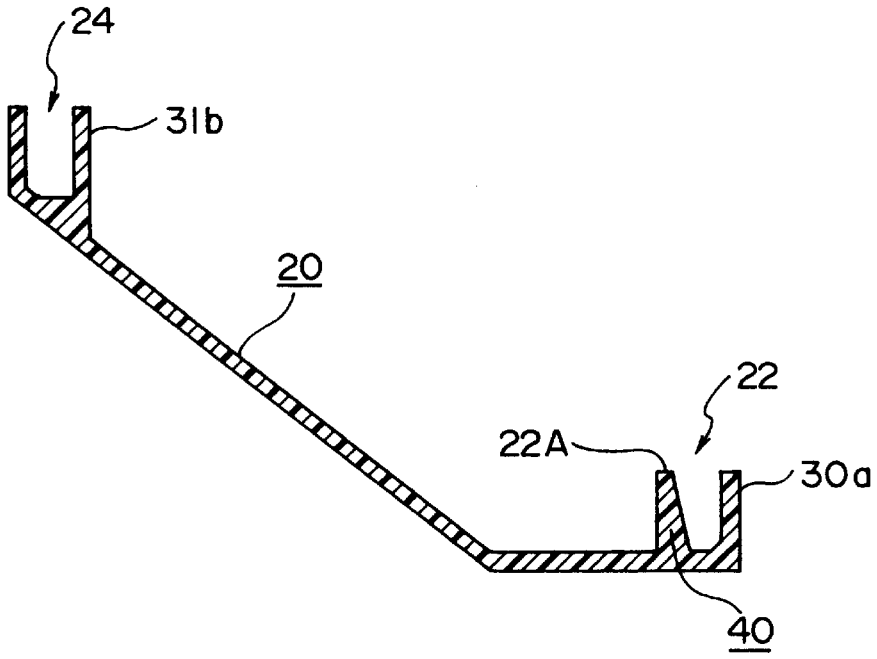
FIGS. 6A and 6B are sectional views, which is similar to FIGS. 3A and 3B, of a bobbin on which the coil winding direction is changed.
Figure 6B:
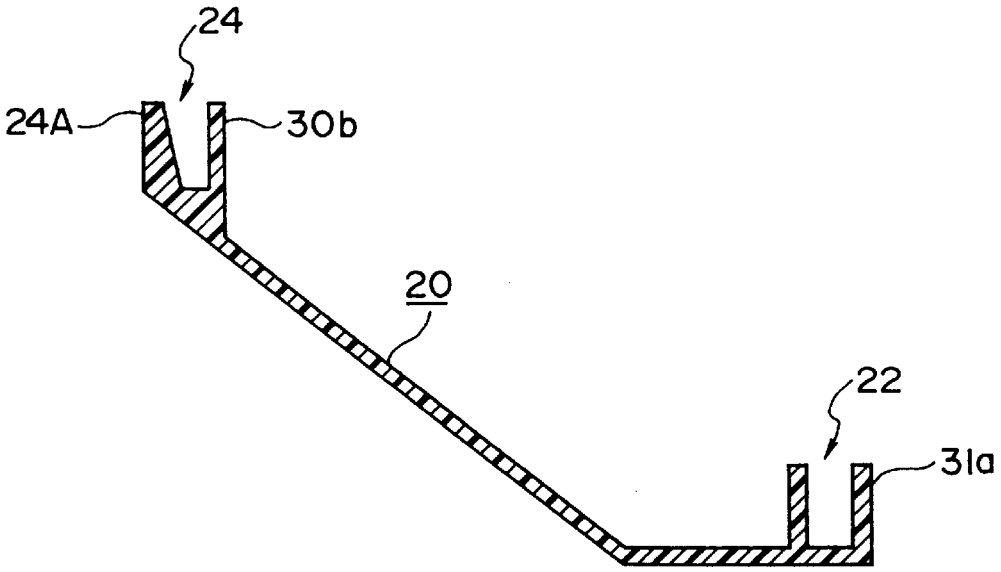
Figure 8:
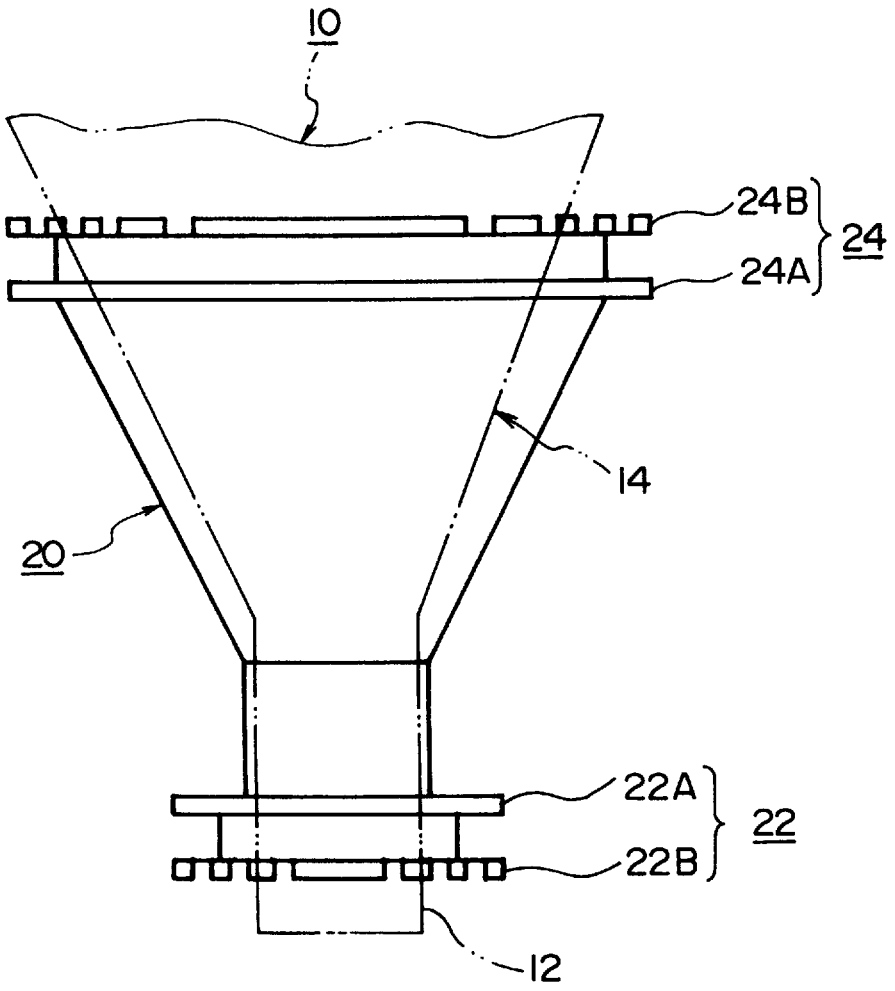
FIG. 8 is a view showing a relationship between a CRT and a bobbin.
Figure 9:
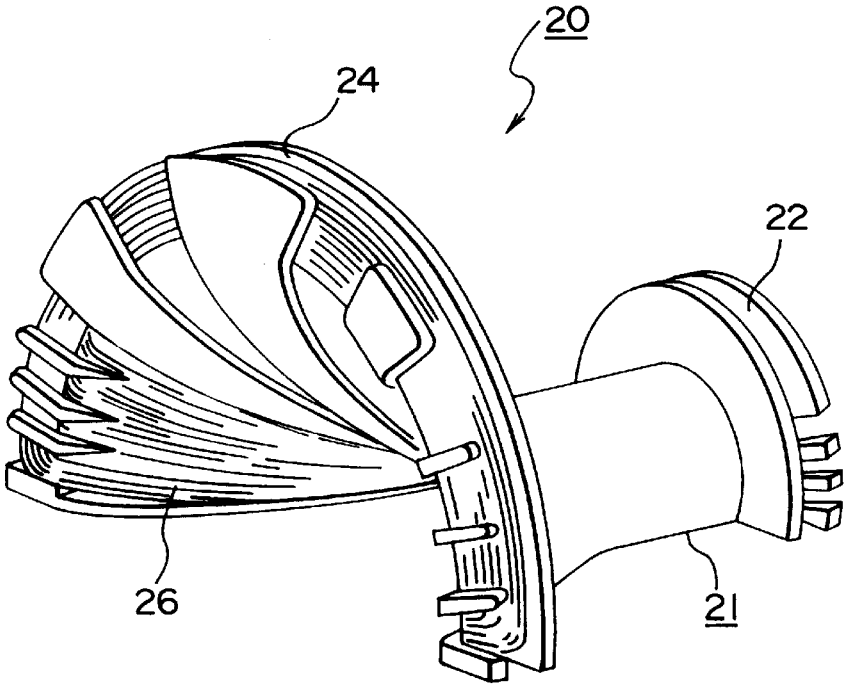
FIG. 9 is a perspective view of a bobbin for a deflection coil.
Figure 10:
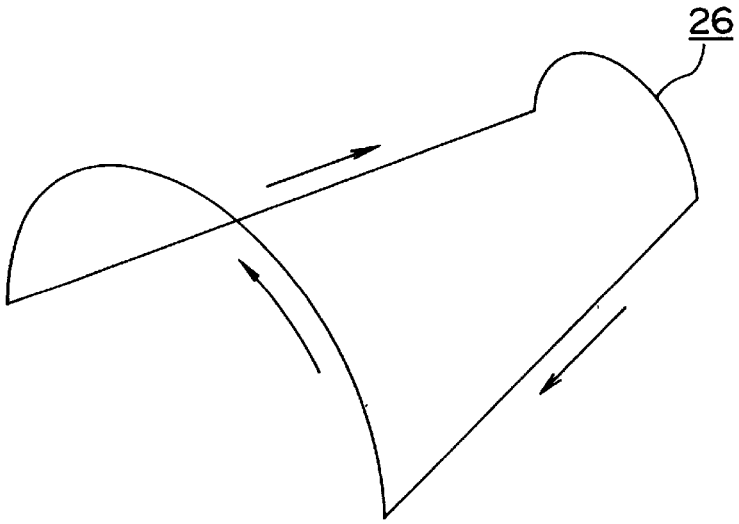
FIG. 10 is a view for illustrating saddle-shaped winding.
Figure 11A:
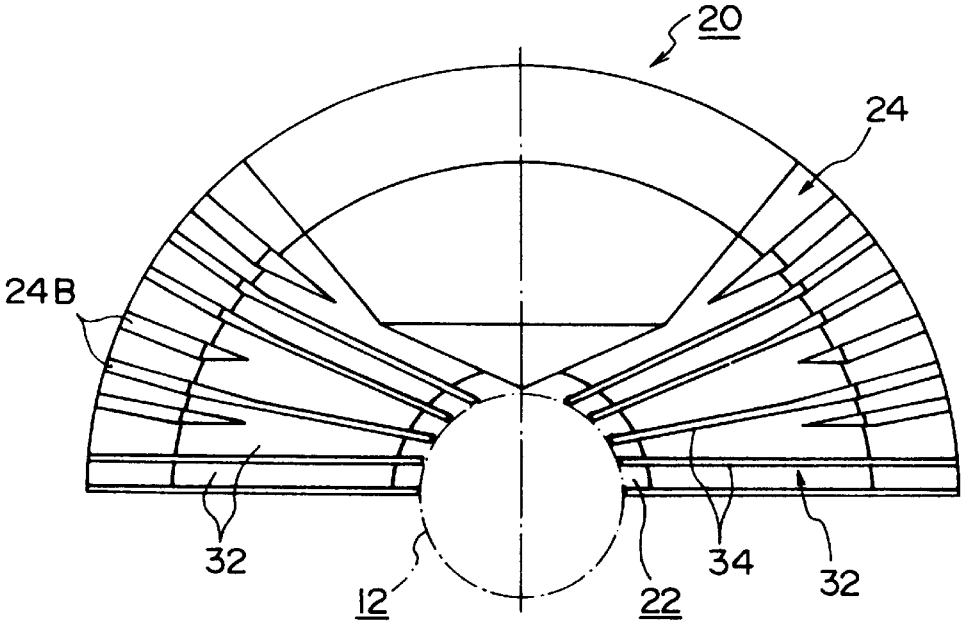
FIGS. 11A and 11B are views of a conventional bobbin for a deflection coil.
Figure 11B:
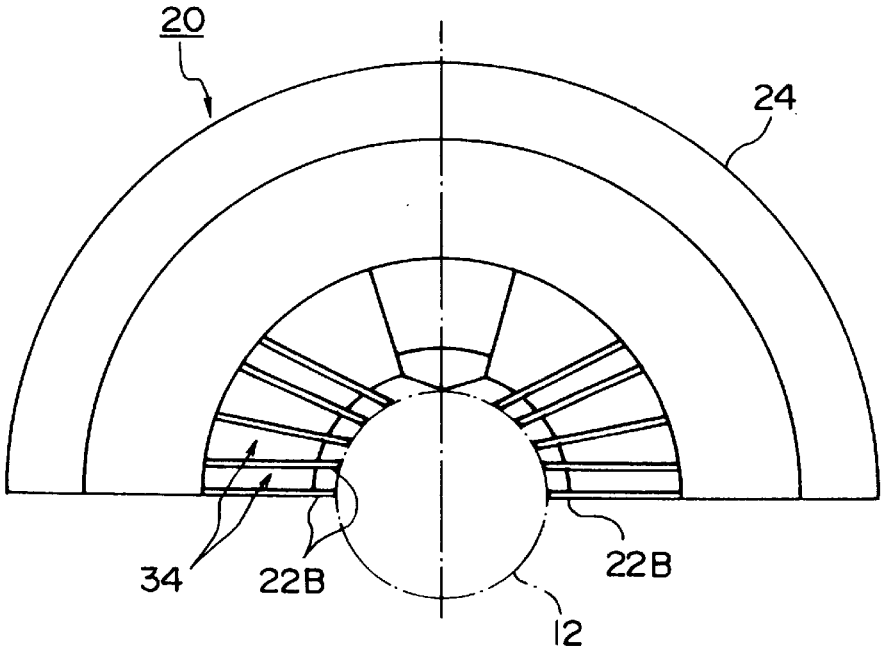
Figure 12A:
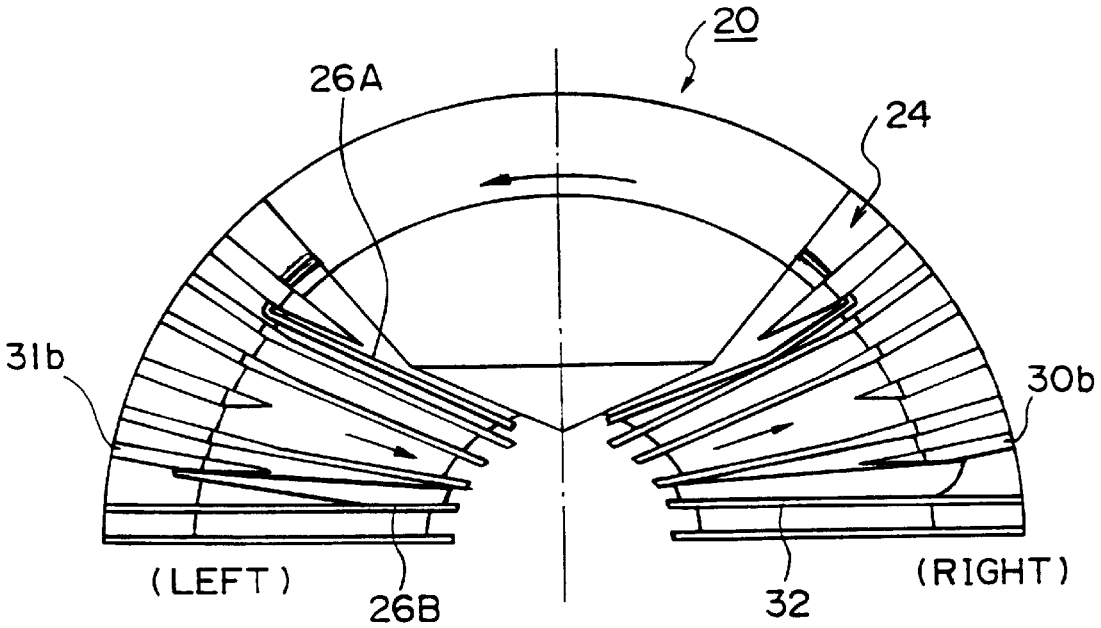
FIGS. 12A and 12B are views showing a state in which a deflection coil is wound on the bobbin for a deflection coil shown in FIGS. 11A and 11B.
Figure 12B:
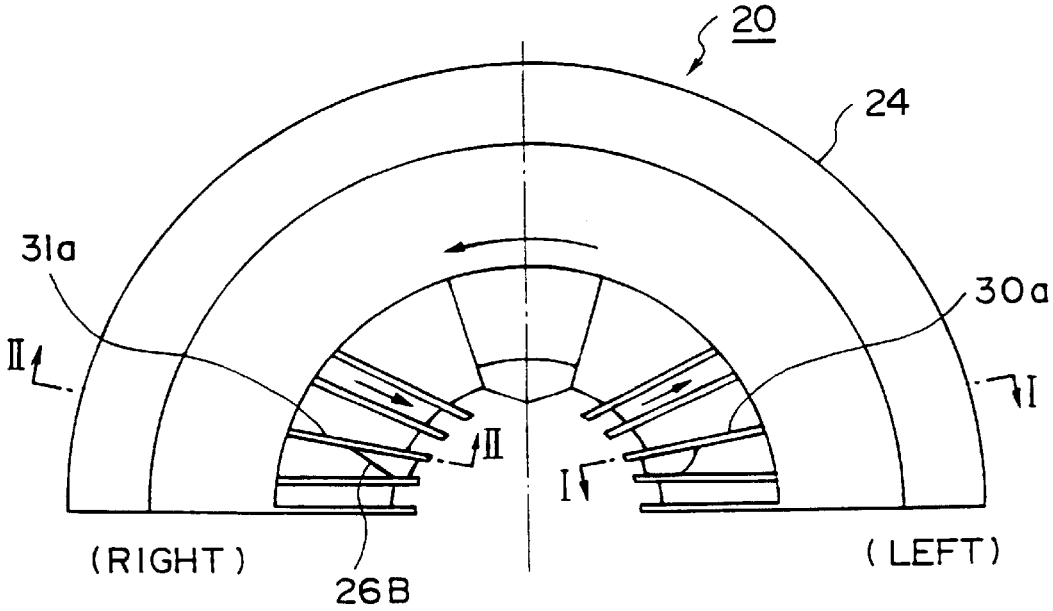
Figure 13A:
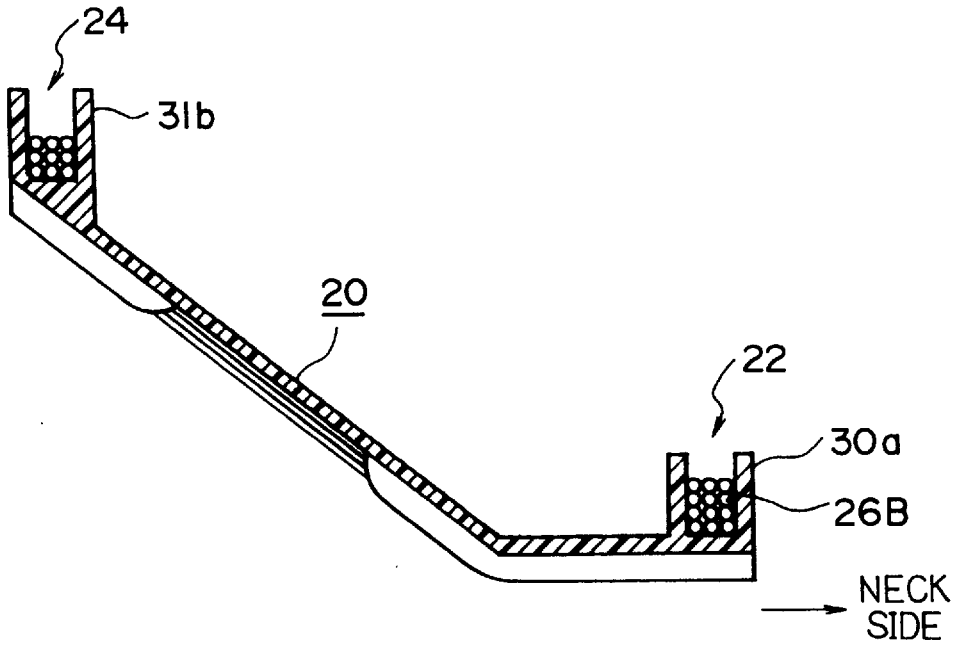
FIGS. 13A and 13B are sectional views of FIG. 12B.
Figure 13B:
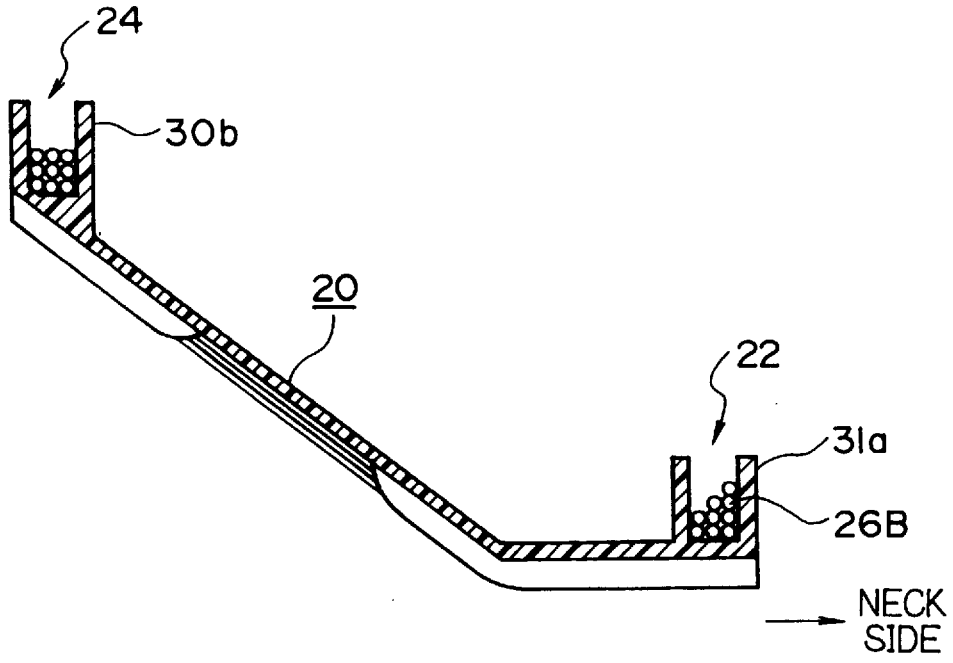

The construction shown in FIGS. 3A and 3B is for the case where the horizontal deflection coil 26 is wound in the arrow-marked direction in FIGS. 1 and 2. When the winding direction is reverse to this, the flange side acts as a support point. In this case, therefore, at the bend 22, a thick-wall portion of the coil layer regulating portion 40 is formed at a flange 22A on the right side of the bobbin 20 as shown in FIG. 6A, and at the bend 24, the coil layer regulating portion 40 is formed at a flange 24A on the left side of the bobbin 20 as shown in FIG. 6B. The coil layer regulating portion 40 is not always configured by an inclined face, but may be formed thick so that a part of the flange has the same thickness as shown in FIG. 7.

In the above embodiments, the present invention is applied to a bobbin for a CRT apparatus such as a television receiving set. However, this is one example. Also, the coil wound on the bobbin 20 is not limited to the horizontal deflection coil.

As described above, in a bobbin for a deflection coil in accordance with the present invention, when a deflection coil is wound from the bend onto the inner surface of the bobbin body, the coil layer regulating portion is formed at the claw of bend, and when a deflection coil is wound from the inner surface of the bobbin body onto the bend, the coil layer regulating portion is formed at the flange of the bend.

According to this invention, since the coil is wound on the bend and coil groove of the bobbin in a well-balanced manner by the coil layer regulating portion formed at the claw or flange, the difference in effective length of coil and the difference in coil distribution at the right and left of the bobbin are improved greatly by merely eliminating the wrong winding of coil, so that the occurrence of picture distortion and misconvergence caused by these differences can be improved.

As many apparently different embodiments of this invention may be made without departing from the spirit and scope thereof, it is to be understood that the invention is not limited to the specific embodiments thereof except as defined in the appended claims.

What is claimed is:

1. A deflection system for a cathode ray tube comprising:

a bobbin mounted on an outer peripheral surface of the cathode ray tube between a neck and a funnel thereof and having left and right sides viewed from a front of the cathode ray tube;

a front bend formed onto an inner surface of the bobbin adjacent the funnel and a rear bend formed onto the inner surface of the bobbin adjacent the neck, the front and rear bends forming coil receiving grooves;

a plurality of funnel claws formed on the front bend and a plurality of neck claws formed on the rear bend, the coil receiving grooves crossing said claws;

a deflection coil formed of windings wound counter clockwise from the inner surface of the bobbin onto a first funnel claw on the right side of the front bend through the groove on the first funnel claw, through the groove on a second funnel claw on the left side of the bobbin, onto the inner surface of the bobbin onto a first neck claw on the left side of the neck bend through the groove on the first neck claw, through the groove on a second neck claw on the right side of the bobbin and onto the inner surface of the bobbin, whereby said first funnel claw and said first neck claw are support points;

a first coil layer regulating portion being formed from a portion of the groove on the first funnel claw, the first coil layer regulating portion having a coil winding receiving portion being wider at an open side than at a closed side, wherein windings on the first funnel claw are biased toward the front of the cathode ray tube; and a second coil layer regulating portion being formed from a portion of the groove on the first neck claw, the second coil layer regulating portion having a coil winding receiving portion being wider at an open side than at a closed side, wherein windings on the right side of the bobbin are biased toward the neck of the cathode ray tube.

2. A deflection system for a cathode ray tube comprising:

a bobbin mounted on an outer peripheral surface of the cathode ray tube between a neck and a funnel thereof and having left and right sides viewed from a front of the cathode ray tube;

a front bend formed onto an inner surface of the bobbin adjacent the funnel and a rear bend formed onto the inner surface of the bobbin adjacent the neck;

a funnel flange formed on the front bend and a neck flange formed on the rear bend, the funnel and neck flanges forming grooves;

a deflection coil formed of windings wound so that the windings run counter clockwise from the inner surface of the bobbin around a first edge of the funnel flange at the right side of the bobbin through the groove of the funnel flange around a second edge of the funnel flange at the left side of the bobbin, along the inner surface of the bobbin, around a first edge of the neck flange at the left side of the bobbin, through the groove of the neck flange around a second edge of the neck flange at the right side of the bobbin and along the inner surface of the bobbin; and a first coil layer regulating portion being formed at the first edge of the funnel flange, the first coil layer regulating portion having a coil winding receiving portion being wider at an open side than at a closed side, wherein windings on the right side of the bobbin at the funnel flange are biased toward the funnel of the cathode ray tube; and a second coil layer regulating portion being formed at the first edge of the neck flange, the second coil layer regulating portion having a coil winding receiving portion being wider at an open side than at a closed side, wherein windings on the neck flange at the left side of the bobbin are biased toward the neck of the cathode ray tube.

* * * * *